US011166497B1

(12) United States Patent
Wilson et al.

(10) Patent No.: US 11,166,497 B1
(45) Date of Patent: Nov. 9, 2021

(54) PROTECTIVE HEADGEAR

(71) Applicant: Larin Company, Brooklyn, NY (US)

(72) Inventors: Lane Wilson, Bruceton Mills, WV (US); Erin Vali, Brooklyn, NY (US); Anna Tobler, Brooklyn, NY (US); Michael Nash, Rockville, MD (US)

(73) Assignee: Larin Company, Brooklyn, NY (US)

( * ) Notice: Subject to any disclaimer, the term of this patent is extended or adjusted under 35 U.S.C. 154(b) by 0 days.

(21) Appl. No.: 17/233,055

(22) Filed: Apr. 16, 2021

(51) Int. Cl.
*A41D 13/002* (2006.01)
*A41D 13/11* (2006.01)

(52) U.S. Cl.
CPC ..... *A41D 13/0025* (2013.01); *A41D 13/1153* (2013.01); *A41D 13/1161* (2013.01)

(58) Field of Classification Search
CPC .. A42B 3/24; A42B 3/28; A42B 3/286; A62B 17/003; A62B 17/006; A62B 17/04; A62B 18/003; A62B 18/045; A62B 18/006; A41D 13/0025; A41D 13/1153
See application file for complete search history.

(56) References Cited

U.S. PATENT DOCUMENTS 3,822,698 A 7/1974 Guy
4,676,236 A 6/1987 Piorkowski et al.
4,901,716 A 2/1990 Stackhouse et al.
5,133,344 A 7/1992 Jurrius et al.
5,561,862 A * 10/1996 Flores, Sr. ..... A42B 3/286 2/171.3
5,592,936 A 1/1997 Thomas et al.
5,724,958 A 3/1998 Farnworth et al.
5,878,742 A * 3/1999 Figueredo ..... A62B 18/003 128/201.24
6,279,570 B1 8/2001 Mittelstadt et al.
6,752,146 B1 * 6/2004 Altshuler ..... A62B 17/04 128/201.25

(Continued)

FOREIGN PATENT DOCUMENTS

CN 101822877 B 6/2012
CN 103223214 B 7/2015

(Continued)

OTHER PUBLICATIONS

"3M Science Applied to Life", Frequently Asked Questions, 3M™ Versaflo™ Powered Air Purifying Respirators (PAPRs), 2 Pages.

(Continued)

*Primary Examiner* — Katherine M Moran

(57) ABSTRACT

A protective headgear includes two air chambers connected through a fan. Each air chamber has a fabric filter with a large surface area. A frame with a fan compartment and headband engages a person's head and forms a boundary to air flow around the head between the two air chambers. Air flows between the two air chambers primarily through the fan. One air chamber is formed above the head and is at lower pressure than air outside the headgear. Another air chamber is formed around the face and is at higher pressure than air outside the headgear. The fan draws air through a fabric filter to provide filtered air into the air chamber around the face, providing breathing volume and positive pressure protection. Exhaled air dissipates out of the headgear through a fabric filter forming part of the air chamber around the face.

30 Claims, 7 Drawing Sheets

(56) References Cited

U.S. PATENT DOCUMENTS

| | | | | |
|---|---|---|---|---|
| 6,834,646 | B2 | 12/2004 | Alon et al. | |
| 6,973,677 | B2 | 12/2005 | Diaz et al. | |
| 7,275,535 | B1 | 10/2007 | Brockman | |
| 7,357,135 | B2 | 4/2008 | Cunningham et al. | |
| 7,832,396 | B2 | 11/2010 | Abernethy | |
| 8,020,552 | B2 | 9/2011 | Dillon et al. | |
| 8,234,722 | B2 | 8/2012 | Vanderwoude et al. | |
| 8,479,727 | B2 | 7/2013 | Grove et al. | |
| 8,955,168 | B2 | 2/2015 | Manzella et al. | |
| 10,384,084 | B2 | 8/2019 | Isham et al. | |
| 10,449,397 | B2 | 10/2019 | Vanderwoude et al. | |
| 2002/0174481 | A1 | 11/2002 | Tremblay-Lutter et al. | |
| 2006/0048776 | A1* | 3/2006 | Cunningham ..... | A62B 17/04 128/201.22 |
| 2009/0055987 | A1 | 3/2009 | Becker et al. | |
| 2016/0128396 | A1 | 5/2016 | Clemente | |
| 2017/0079359 | A1 | 3/2017 | Chase | |
| 2017/0332721 | A1* | 11/2017 | Otey ..... | A42B 3/227 |

FOREIGN PATENT DOCUMENTS

| | | | |
|---|---|---|---|
| CN | 204732180 | U | 10/2015 |
| CN | 111134403 | A | 5/2020 |
| CN | 111227333 | A | 6/2020 |
| CN | 111317193 | A | 6/2020 |
| CN | 111420316 | A | 7/2020 |
| EP | 0474372 | A2 | 3/1992 |
| GB | 1426432 | A | 2/1976 |
| GB | 2032284 | B | 11/1982 |
| GB | 2580570 | A | 7/2020 |
| JP | 2007275190 | A | 10/2007 |
| RU | 2734299 | C1 | 10/2020 |
| WO | 8300632 | A1 | 3/1983 |
| WO | 2018183872 | A1 | 10/2018 |

OTHER PUBLICATIONS

"3M Science Applied to Life", PAPR Comparison Charts LR, 3 Pages.

"Comfort Simplicity Versatility", 3M™ Versaflo™ S-Series Hoods and Headcovers for Powered and Supplied Air Respirators, 3M.com/Versaflo, 12 Pages.

"Product Matrix: 3M™ Versaflo™", 14 Pages.

"Three systems. One solution : Power your day", 3M Science Applied for Life.™, 2017, 4 Pages.

Konda, Abhiteja, et al., "Aerosol Filtration Efficiency of Common Fabrics Used in Respiratory Cloth Masks", ACSNANO, URL: www.acsnano.org, Apr. 24, 2020, pp. 6339-6347.

Stauffer, McKenzie , "BYU researchers: This invention makes cloth masks as effective as N95 masks", Oct. 21, 2020, 11 pages.

UW Makerspace , "Open-Source Papr Hood", URL: https://making.engr.wisc.edu/, 2020, 5 Pages.

* cited by examiner

PROTECTIVE HEADGEAR

BACKGROUND

There are many environments or situations in which a person may want or may be required to wear a form of protective headgear. Some forms of protective headgear are designed to ensure that the air breathed in by the person is safe. Most forms of protective headgear are not designed for use in everyday life. Instead, they tend to be designed for individuals who are engaging in specific activities, such as health care, manufacturing, public safety, and the like, where the burdens of wearing the protective headgear are among the expectations of a job. Such protective headgear may be heavy, or large, or bulky, or may restrict eating or drinking, or may be made of costly materials, or may be costly to make, distribute, or sell. Most such protective headgear is not suitable for broad consumer use during activities of everyday life.

SUMMARY

This Summary introduces a selection of concepts in simplified form that are described further below in the Detailed Description. This Summary neither identifies key or essential features, nor limits the scope, of the claimed subject matter.

Due to an increase in the presence of communicable, airborne diseases, such as viruses and bacteria, protective headgear that is suitable for broad consumer use is desirable.

A protective headgear includes two air chambers, each having a fabric filter with a large surface area, and which are connected through a fan. A frame with a fan compartment and headband engages a person's head and forms a boundary to air flow around the head between the two air chambers. Air flows between the two air chambers primarily through the fan. One air chamber is formed above the head and is at lower pressure than air outside the protective headgear. The other air chamber is formed around the face and is at higher pressure than air outside the protective headgear. The fan draws air through a fabric filter (defining part of the air chamber above the head) to provide filtered air into the air chamber around the face, that provides breathing volume for the person and positive pressure protection. The air flow rate should be high enough to supply filtered breathing air to the wearer and create a positive pressure air flow opposing any inward drift of any ambient harmful aerosol or dust in the environment. Exhaled air dissipates out of the headgear through a fabric filter forming part of the air chamber around the face, due to the higher pressure in that air chamber.

By having sufficiently large air volumes in the air chambers, and sufficiently large surface areas for the fabric filters, a fan with low rotational velocity, and lower pressures can be used. Further, the frame, fan, and fabric filters can be lightweight. Each of the components can be lightweight, removable, and replaceable, allowing the protective headgear to be readily portable and manufactured and distributed at lower cost.

The following Detailed Description references the accompanying drawings which form a part of this application, and which show, by way of illustration, specific example implementations. Other implementations may be made without departing from the scope of the disclosure.

It should be understood that the drawings are intended to be illustrative and schematic in nature and are not drawn to scale.

DETAILED DESCRIPTION

Figure 1A:
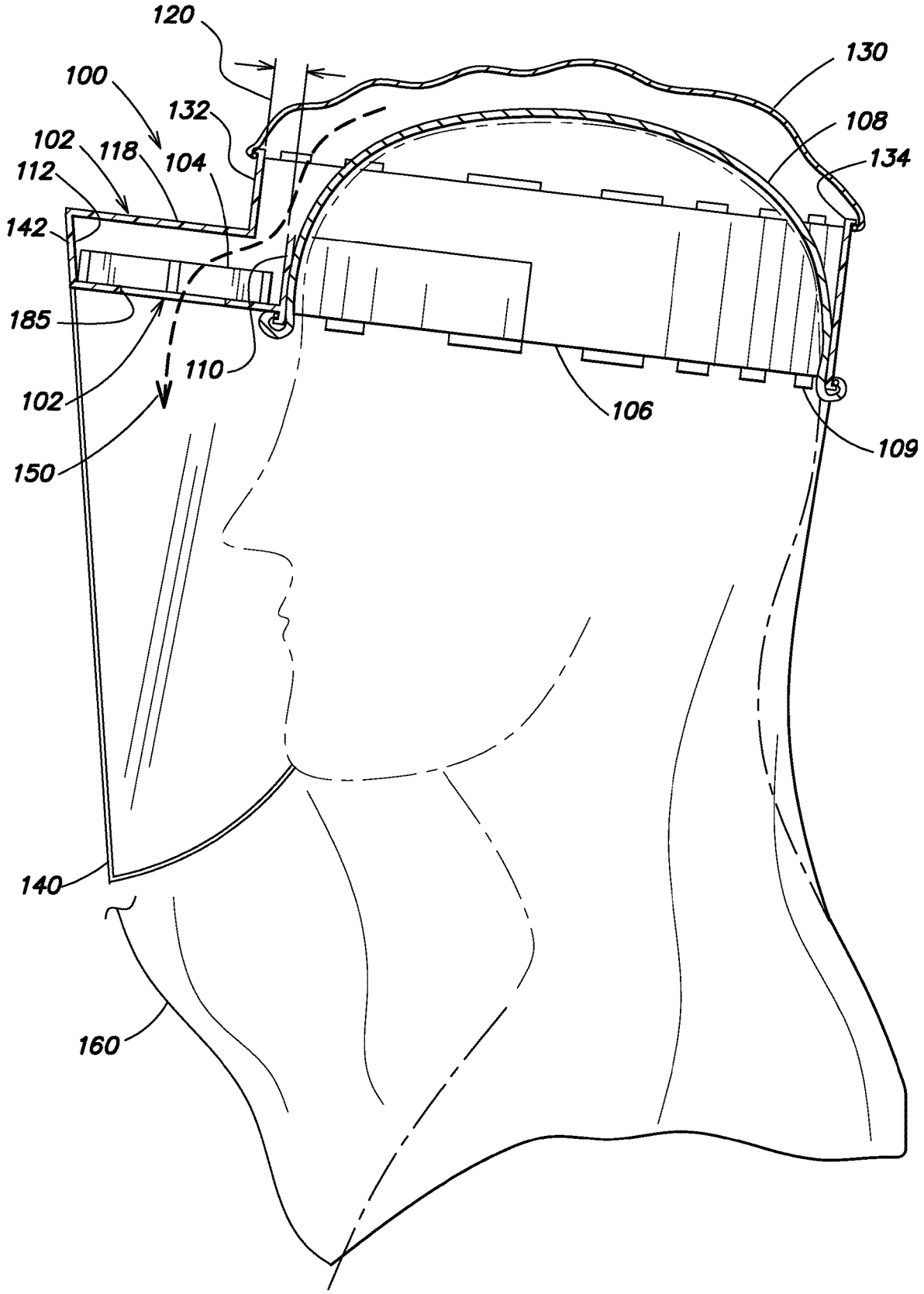
FIG. 1A is an illustrative example of a protective headgear shown in a side, partial cross-section, view.
Figure 1B:
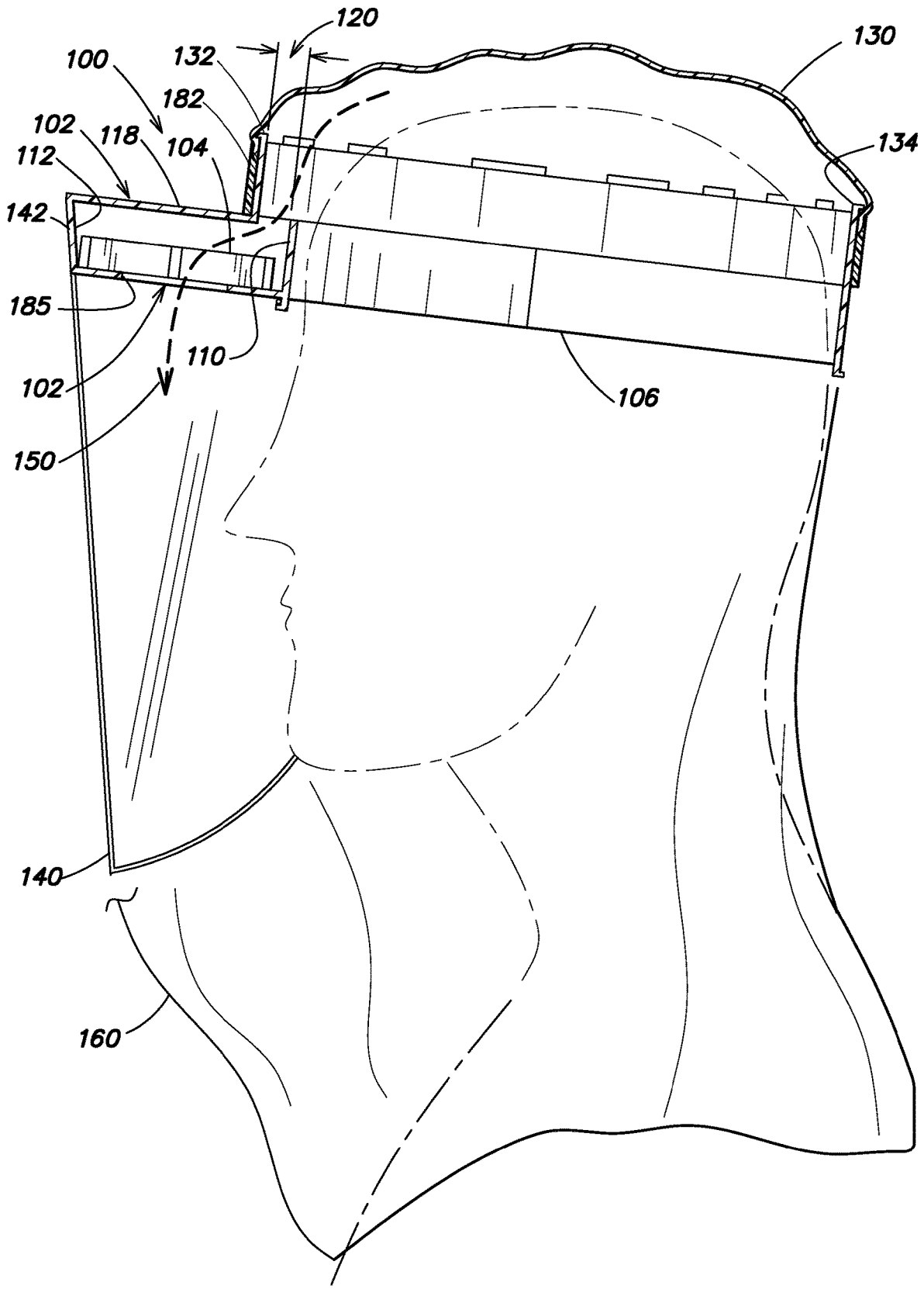
FIG. 1B is an illustrative example of a protective headgear shown in a side, partial cross-section, view.

Referring to FIGS. 1A and 1B, illustrative examples of a protective headgear are shown in side, partial cross-section, views. The protective headgear is configured to be worn on a head of a person.

In FIG. 1A, a frame 100 includes a fan compartment 102, supporting a fan 104, and a headband 106 rigidly connected to the fan compartment 102. The headband 106 has a front portion at the front of the head connected to fan compartment 102 and a back portion at the back of the head. The headband 106 is constructed and arranged to be worn on the head of the person by forming a band that wraps around the head.

The front part of the frame 100 including the fan compartment 102 can be made of hard plastic. The headband 106 can be formed of separate front and back "U"-shaped portions. The headband 106 can be formed of as one integral piece. In some implementations, the front portion of the headband can be made of hard plastic while the back portion of the headband can be made of a hard or soft material. In some implementations, the frame is made of one integral piece, such as through additive manufacturing.

In some embodiments, headband 106 can include an adjustable structure allowing the headband 106 to be adapted to the wearer's head size. In some embodiments, the headband 106 can have a surface on which other material, such as foam inserts that adhere to the surface, can be placed to adapt the fit to the wearer's head size. In some embodiments, the headband 106 can have an opening at the back of the head to which an adjustable strap with a buckle, or hook and loop closure, or a sliding seal can be used to adjust the fit. In some embodiments, any other structures typically used to adjust the fit of a hat or helmet to a person's head can be used. The back portion can include a cushion to provide more comfort to the person when resting back onto a seat in an office chair, car seat or plane seat.

The frame 100, with the fan compartment 102 and headband 106 provide a structure that can be worn on the head much like a hat. When the protective headgear is worn, the headband 106 engages the head and is used to form a boundary or seal to air flow around the head, between the first air chamber, defined partially by the fabric bottom and face mask, and the second air chamber, defined partially by the fabric top. The term "seal" or "boundary" is intended to mean any sufficient barrier against movement of aerosols, which may be less than an airtight or watertight seal, and can typically be provided by a filter material bunched or pressed against an impermeable surface.

In the example implementation shown in FIG. 1A, the boundary can be provided using a material seal 108, formed of a fabric, plastic, or other material, which covers the head and attaches to the headband 106. As shown in FIG. 1A, the material seal 108 sits on the head of the person, and, in combination with headband 106, forms a surface barrier between an area above the head, and an area around the face, where two air chambers are formed as described below. A material seal 108 also can keep hair from going into the fan compartment 102 or fan 104. The material seal can be made of a fabric that is removable. The fabric can have an elastic edge enabling it to engage structures, e.g., lips 109, on the headband 106. By using a fabric or a removable material for the material seal 108, the frame 100 can be substantially flat when not worn.

In some embodiments, such as in the example implementation shown in FIG. 1B, the seal formed between the headband 106 and the head may be sufficient to form a suitable surface barrier. In such implementations, the wearer's head serves as part of the boundary separating the lower air chamber from the upper air chamber and the top of the head defines, in part, the upper air chamber.

The fan compartment 102 has a back interior edge 110 along the front portion of the headband 106 and has a front interior edge 112. A fan 104 is supported between the front and back interior edges within the fan compartment 102. The fan compartment is defined in part by a top face 118 which forms an opening 120 with the back interior edge 110. In various embodiments, the size of the top face can range from narrow, such that the opening 120 extends almost or entirely to the front interior edge 112, to wide, such that the opening 120 is narrow. The top face 118, or other structure defining the fan compartment 102 such as the portion with opening 185, can be hinged or otherwise removable or openable to allow access to the fan compartment 102 for cleaning the fan compartment, cleaning the fan 104, replacing the fan 104, or for other maintenance, for example. The fan compartment 102, in this illustration, forms a sort of brim of a cap, wherein the fan compartment 102 is sized to house the fan 104 and allow airflow through opening 102, through the fan, and exiting the fan compartment through opening 185.

The frame 100 is combined with a transparent face mask 140, a fabric top 130, and a fabric bottom 160 to complete the protective functions of the protective headgear.

The transparent face mask 140 connects along an exterior edge or surface 142 of the frame 100, primarily along the fan compartment 102, as shown in more detail below in connection with FIG. 2. The connection can be made using any technique that attaches the face mask to the frame, such as a hook and loop closure, an adhesive, a zipper, a track-like structure, or any other kind of closure that provides a seal along the length of the connection.

The fabric bottom 160 is formed of a filtering fabric that is connected to a bottom portion of the frame and the face mask. In this example, the fabric bottom 160 is connected along edges of the transparent face mask 140 and edges of the back portion of the headband 106, as shown in more detail below in connection with FIG. 2. The connection can be made using any technique that attaches the fabric bottom to the face mask and to the headband, such as a hook and loop closure, an adhesive, a zipper, a track-like structure, or any other kind of closure that provides a seal along the length of the connection. The fabric bottom 160 further extends down to and rests on the person's shoulders, back, and chest, around the head, so as to form a first air chamber. Material forming the fabric bottom has a length much greater than a distance from the frame to the shoulders of the person, so that the fabric bottom forms a seal due to the weight and folding of the fabric bottom on the wearer's body. In some implementations, a drawstring in the fabric bottom, such as at a location around the neck, can be an alternative for a loose fabric seal. The drawstring can provide for a tighter seal, and an adjustable drawstring allows the wearer to cinch down and tighten up the seal when in more hazardous conditions. Thus, the first air chamber is defined by the frame 100, the transparent face mask 140, and the fabric bottom 160, and the wearer's body.

The fabric bottom 160 forms a lower filter surface with a large surface area. By having a sufficiently large surface area, a fan with lower rotational velocity, and lower air pressure can be used, as described below.

With this fabric bottom, a lower air chamber is defined without having the shoulders directly supporting significant weight of the headgear. Only the fabric bottom rests directly on the shoulders, and the remainder of the headgear rests directly on the head or is suspended from the frame which is resting on the head. Further, as described in more detail below, when the fabric bottom is made of a sufficient length of material such that it rests loosely on the shoulders, a variety of other benefits are provided to the wearer.

The fabric top 130 is formed of a filtering fabric that is connected on a top portion of the frame. In the examples shown in FIGS. 1A and 1B, the fabric top is a piece of fabric with an elastic edge that connects to structures, e.g., lips 132 along the top face 118, so as to cover the opening 120, and then along lips 134 along the back portion of the headband 106. The fabric top attached to the frame 100 in a manner covering opening 120 forms a second air chamber. The second air chamber is thus defined by the frame 100 and the fabric top 130, and any material seal 108 or the wearer's head.

The fabric top 130 forms an upper filter surface with a large surface area. By having a sufficiently large surface area, a fan with lower rotational velocity, and lower air pressure can be used, as described below.

A form of structural support (not shown in FIGS. 1A and 1B) can be provided to maintain a space between the fabric top 130 and any material seal 108 (FIG. 1A) or the wearer's head (FIG. 1B) to maintain the volume of the second air chamber. Examples of such a structural support are described in more detail below in connection with FIGS. 3A and 3B.

Electronics for the fan typically include wires to provide power from one or more batteries and a switch. These components can be placed anywhere within the headgear. For example, batteries and a switch may be placed in or on the frame compartment. Connections may be provided through which other wiring can be connected to charge the batteries.

Air flow between the first air chamber and the second air chamber is primarily through the opening 120 in the frame, through the fan 104, and through the opening 185, as shown by the arrow 150 in FIGS. 1A and 1B. So, when the fan is in operation while the headgear is being worn, air is drawn from through the upper filter surface of the fabric top 130 into the second air chamber, through the opening 120, fan 104, and opening 185, and into the first air chamber. Air leaves the protective headgear through the lower filter surface defined by the fabric bottom 160. In this operation, the second air chamber is at lower pressure than air outside the protective headgear, and the first air chamber is at higher pressure than air outside the protective headgear. Thus, the protective headgear provides filtered air through the upper filter surface from the second air chamber into the first air chamber to provide breathing volume for the person with positive pressure protection.

By having sufficiently large air volumes in the air chambers, and sufficiently large surface areas for the fabric filters, a fan with low rotational velocity, and lower pressures can be used. A sufficiently large surface area for each of the fabric filters is based at least on breath rate and filter permeability. Generally, the surface area of the fabric filters should be such that the pressure difference between the air chambers and outside the headgear are small, but air flow rate provides enough fresh air at the wearer's breathing rate, allowing an inexpensive and quiet fan to be used. The air flow rate should be high enough to supply filtered breathing air to the wearer and create a positive pressure air flow opposing any inward drift of any ambient harmful aerosol or dust in the environment. Given a fan, which may also be selected based on noise, size, power consumption and other specifications in addition to flow rate, then a desirable surface area specification can be determined, noting that a typical human breath rate is in the range of 10 to 20 breaths per minute, with an average around 15 breaths per minute, with about ½ liter of air per breath. Other factors than can affect selection of a fan and the surface areas of the filter fabrics include humidity, temperature, and tightness of the positive pressure neck seal. In the example implementations, shown herein, the filter area is roughly 1000 square centimeters ($cm^{-2}$).

Figure 2:
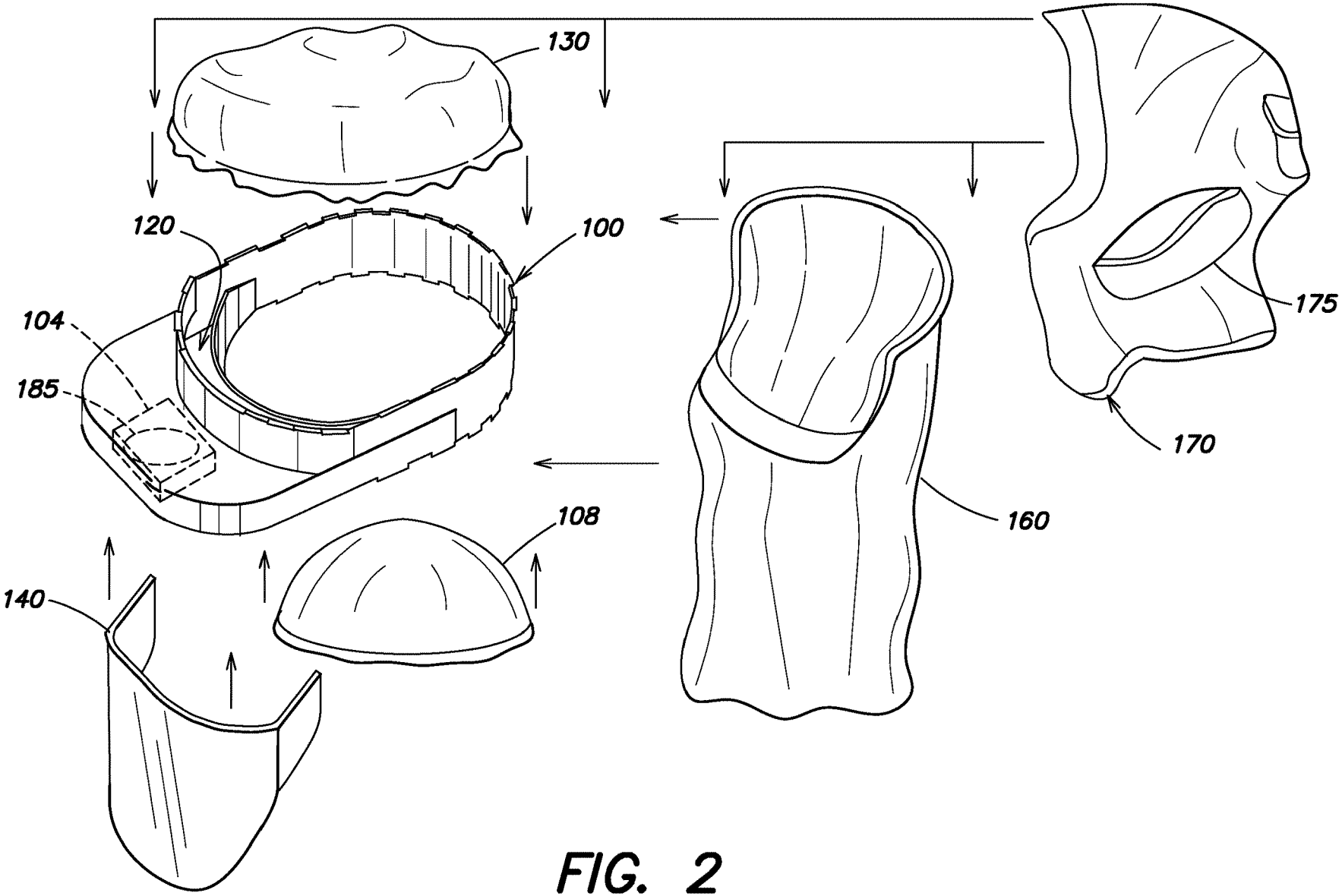
FIG. 2 is an exploded perspective view of an example implementation.

Turning now to FIG. 2, an exploded perspective view of an example implementation of the protective headgear will now be described.

In FIG. 2, the frame 100 has an opening 120 that allows air to flow into the fan compartment 102. The fan compartment 102 is shown with a circular opening 185 (the fan 104 is not shown) on a bottom portion, through which air flows out of the fan into the air chamber around the face.

The headband 106 of the frame 100 wraps around the wearer's head. A material seal 108, if used, is shown as being inserted into the frame 100 from the bottom, on the interior of the headband 106. A variety of techniques can be used to secure the material seal 108 to the headband 106 part of the frame 100.

The fabric top 130 is connected to the top of the frame 100, such that the opening 120 to the fan compartment is within the air chamber formed between the fabric top 130 and any material seal 108. A variety of techniques can be used to secure the fabric top 130 to the frame 100.

The transparent face mask 140 connects to the front portion of the frame 100. The transparent face mask generally extends along the entire front of the frame, and then to an extent long each side of the frame, extending to the back of the frame along the headband portion. The extent of the face mask along the sides of the frame should be sufficient so as to not block peripheral vision of the wearer.

The fabric bottom 160 (not to scale) connects along a bottom edge of the face mask 140 and the back portion of the headband 106 of the frame 100. As described in more detail below, the fabric bottom can be in the form of a cloth tube, with a top edge shaped to match an edge defined by the face mask 140 and headband 106 of the frame 100 when the face mask is attached to the frame.

Figure 6:
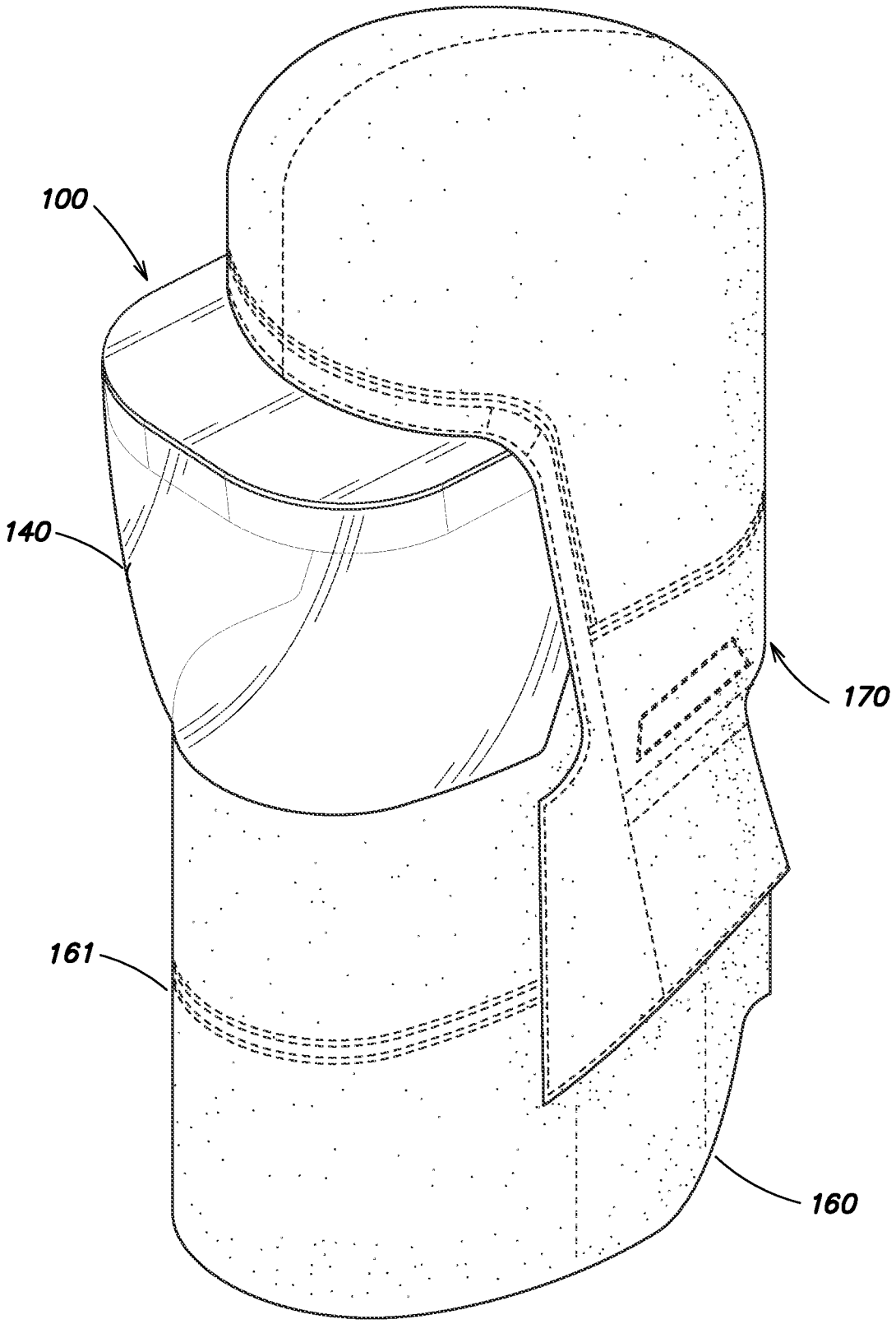
FIG. 6 is a perspective view of an example implementation of an assembled headgear.

After the face mask 140, fabric bottom 160, any material seal 108, and fabric top 130 are connected to the frame 100, forming an assembly of the protective headgear, a decorative hood 170 (not to scale) also can be worn over the assembly. An example implementation of the complete assembly is shown in FIG. 6, wherein the fabric bottom is a form of cloth tube hanging from the frame. When worn this cloth tube would bunch on the wearer's back, chest, shoulders, and neck to form a seal. In some implementations, a drawstring in the fabric bottom, such as at a location around the neck as shown at 161, can be an alternative for a loose fabric seal. The drawstring can provide for a tighter seal, and an adjustable drawstring allows the wearer to cinch down and tighten up the seal when in more hazardous conditions. In some embodiments, the drawstring is coupled midway at the neck point, as shown at 161, with longer hanging fabric which continues from the drawstring point down to the shoulders. In this configuration the drawstring can be cinched or left open, reverting back to the loose fabric seal that allows more space for hand manipulation on either side.

The decorative hood may include a pocket 175 for holding electronic components, such as batteries, chargers, controller for the fan, etc. In some embodiments, the hood may hide the fabric top 130, but may allow the front section of the frame 100 to be visible. In some embodiments, the hood may cover the frame 100. In some embodiments, the hood may have a mechanism for attaching an edge of a hood along an outside edge of the frame 100.

In some embodiments, the protective headgear further includes a compartment for housing a plurality of batteries in the fabric bottom, for example along the seal around the neck with the weight of the batteries resting evenly on the shoulders.

As noted above, a variety of techniques can be used to secure any material seal 108 and the fabric top 130 to the frame 100 to form the upper air chamber. A variety of techniques also can be used to support the fabric top 130 above the head to provide sufficient air flow access to the large filter surface of the upper air chamber. Example implementations are shown in FIGS. 3A and 3B.

Figure 3A:
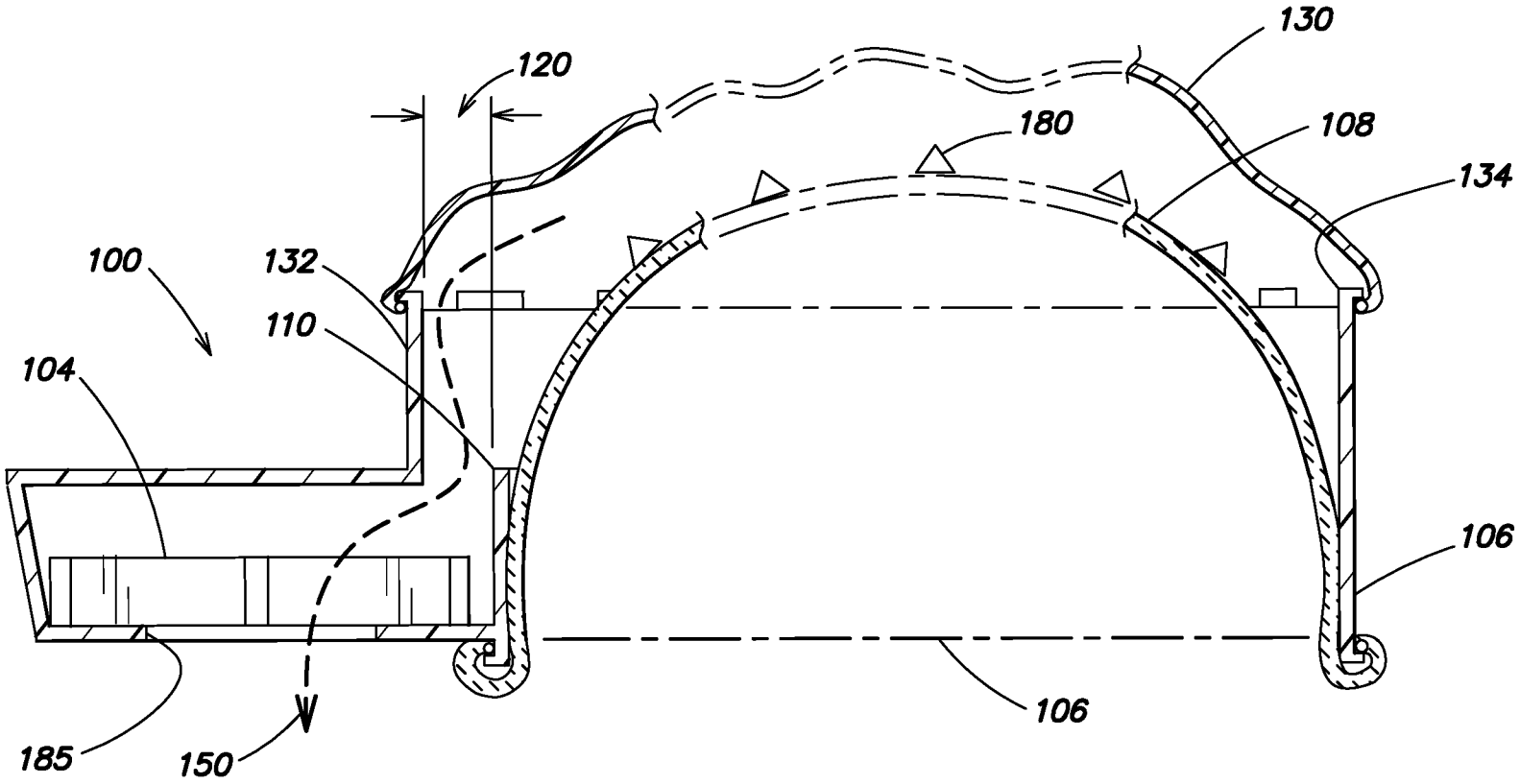
FIG. 3A is a cross-sectional side view of an example implementation.

In FIG. 3A, the top of the frame has one or more structures, e.g., lips 132 and 134, for engaging an elastic material in the fabric top 130. There may be one continuous lip 132, 134, or several segmented lips 132, 134. In the example shown in FIG. 3A, the elastic material is shown as a narrow band, such as an O-ring. The band can be made of any material with sufficient elasticity, such a rubber, and can be separate from or integrated with the fabric top 130. Similarly, the bottom of the frame has one or more structures, e.g., lips 109, surrounding the headband 106 for engaging an elastic material in the material seal 108. There may be one continuous lip or several segmented lips. The material seal 108 is connected to the structures, e.g., lip 109, on the bottom of the frame and pushed through a passage in the frame formed by the headband 106.

Figure 3B:
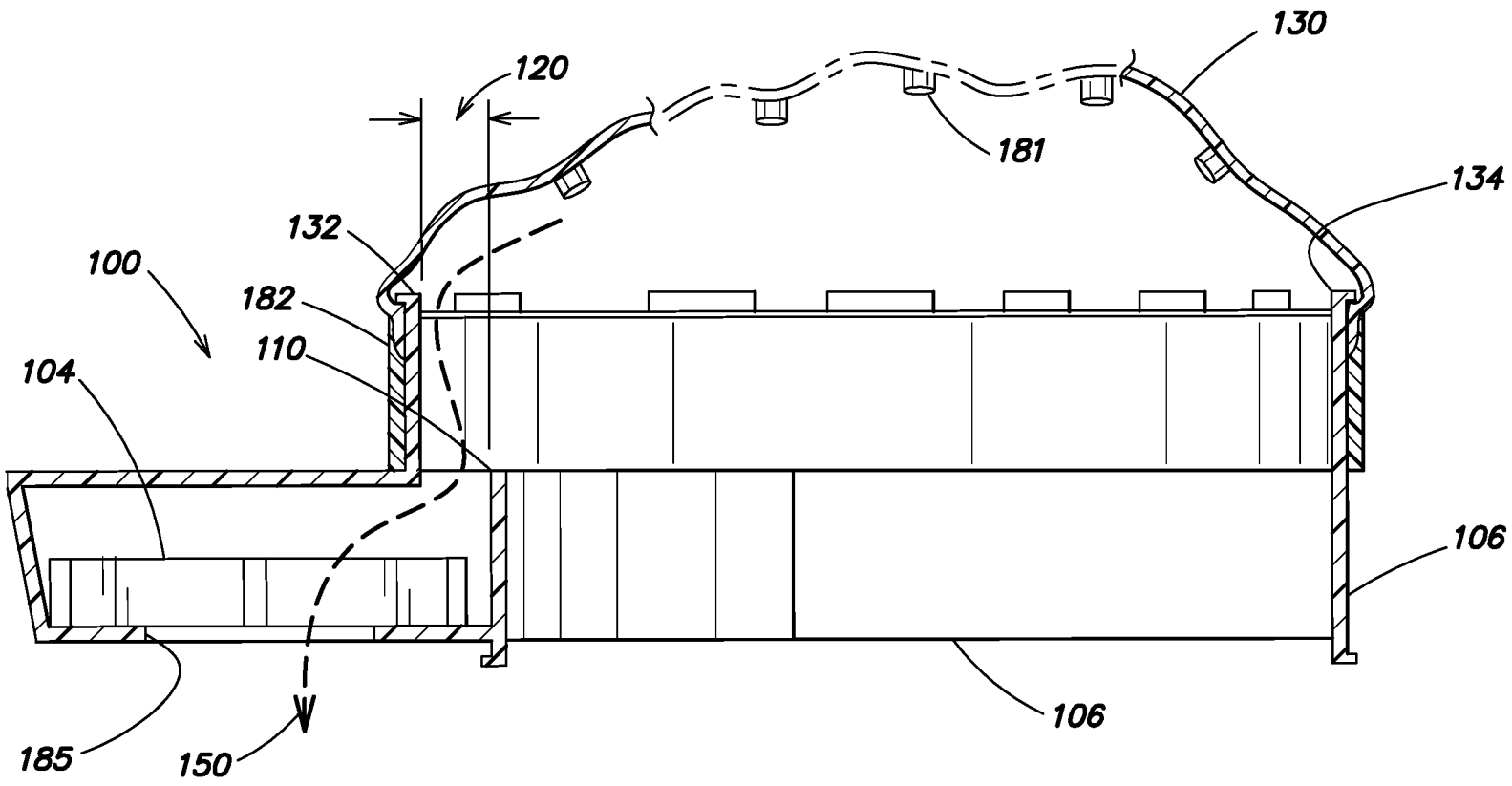
FIG. 3B is a cross-sectional side view of an example implementation.

In FIG. 3B, the top of the frame has one or more structures, e.g., lips 132 and 134, for engaging an elastic material in the fabric top 130. There may be one continuous lip 132, 134, or several segmented lips 132, 134. In the example shown in FIG. 3B, the elastic material is shown as a wide band 182, such as commonly used as a waistband in clothing. The band 182 can be made of any material with sufficient elasticity, and can be separate from or integrated with, e.g., stitched to, the fabric top 130. Structures on the bottom of the frame (as shown in FIG. 3A) can be omitted in this embodiment shown in FIG. 3B. In this embodiment, a continuous wide band of elastic material can lie flat around the entire circumference of the structures around the headband which support lips 132, 134.

A variety of structures could be used to maintain distance between the fabric top 130 and any material seal 108 (FIG. 3A) or the head (FIG. 3B). As one example shown in FIG. 3A, supports 180 can be formed on the material seal 108 to support the fabric top 130. As one example shown in FIG. 3B, supports 181, such as cylinders, can be formed on an interior surface of the fabric top 130 to support the fabric top 130 on the head. By using a pointed structure, such as pyramids or cones, as shown in FIG. 3A, the surface area of the fabric top 130 available for filtering is maximized.

As another example, one or more structures, such as an arch-like support, or a dome-like support, or a mesh, can be connected to the frame or to the fabric top. Such structures would help to form a space above the head. The fabric top 130 can be placed over the opening 120 to the fan compartment and over such structures. The structures hold up the fabric top 130 from the head or any material seal 108 to form the second air chamber.

As another example, structures, e.g., lips 132 and 134, supporting the fabric top 108 can be sufficiently high to ensure adequate filter surface area and air flow in the upper air chamber.

Figure 4:
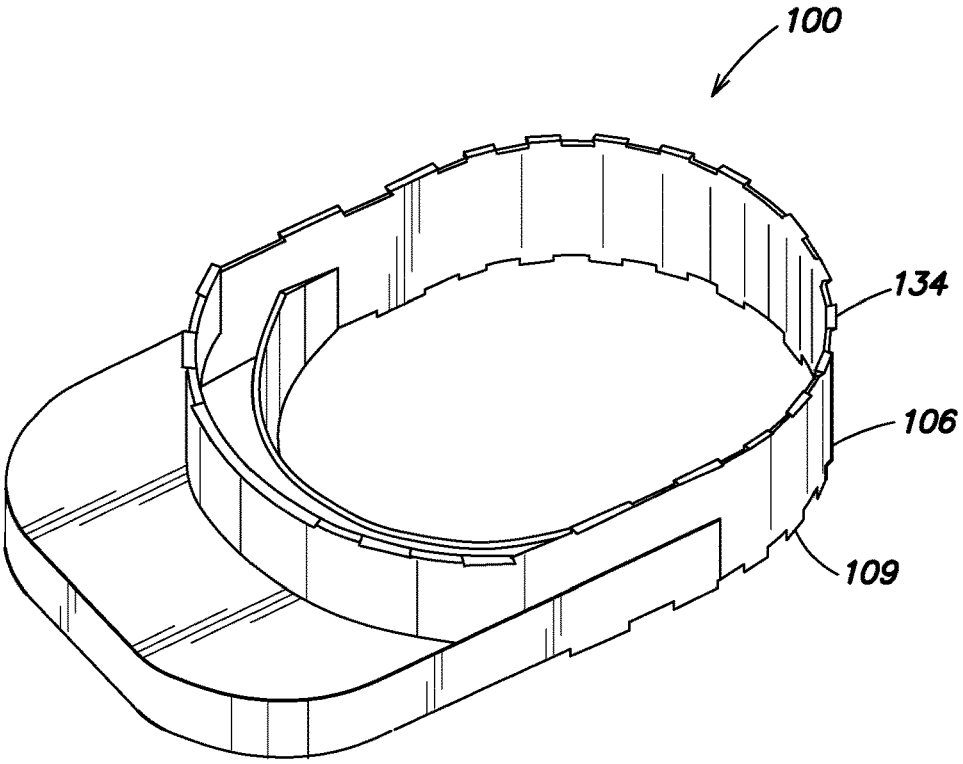
FIG. 4 is a top perspective view of an example implementation of a frame.
Figure 5:
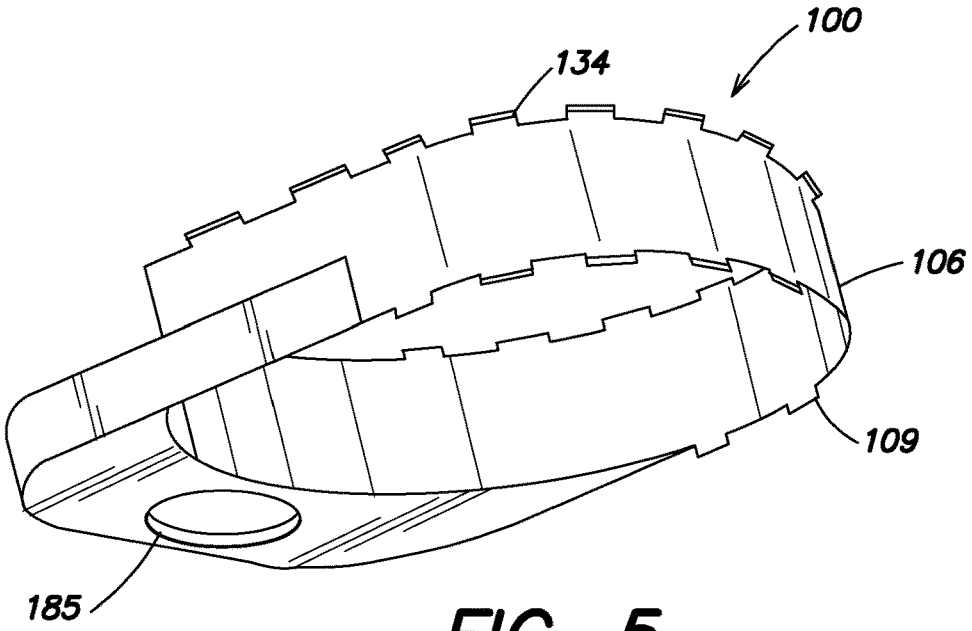
FIG. 5 is a bottom perspective view of an example implementation of a frame.

Turning now to FIGS. 4 and 5, top and bottom, respectively, perspective views of just the frame are shown. As shown in both Figures, the headband 106 would surround a person's head when worn, whereas the fan compartment 102 forms a sort of brim of a cap. The fan compartment 102 can have a variety of shapes and thicknesses, depending on the size of the fan, the desired volume of the compartment, and desired aesthetics. A fan (not shown) draws air into an opening 120, an air inlet of the fan compartment 102, on the top of the frame (FIG. 4). The fan pushes air out opening 185 (FIG. 5), an air outlet of the fan compartment 102, on the bottom of the frame. The fan is constructed and arranged to draw air into the fan compartment through the air inlet and push air out through the air outlet.

Thus, when a fabric top 130 is placed on the top of a frame 100, and the headgear is worn and the fan is on, the fan draws air through a filter with a large surface area (the fabric top) into an upper air chamber formed by the frame 100, the fabric top 130, and the wearer's head. The fan draws air from this upper air chamber into the fan compartment through the opening 120 and pushes air out through the opening 185. With the face mask 140 and the fabric bottom 160 placed on the frame 100, a lower air chamber is formed, defined by the frame 100, face mask 140, fabric bottom 160, and the wearer's head, neck, and shoulders. Thus, when the fan draws air from the fan compartment 102 and pushes air out through the opening 185, the influx of air creates a positive pressure within the lower air chamber, which causes air to be pushed out of the headgear through the large surface area of the filter fabric of the fabric bottom.

The filtering fabric used in the fabric top 130 and fabric bottom 160 can be formed of a variety of kinds of filtering fabrics.

In some embodiments, the filtering fabric comprises a material designed to filter from air at least some percentage of particulates, such as aerosols and droplets, having sizes in range of 10-300 nm to 5-10 μm. The filtering efficiency of the filtering fabric for aerosols and droplets, having sizes in at least part of the range of 10-300 nm to 5-10 μm, is preferably greater than 50%. In some embodiments this filtering efficiency is greater than 60%. In some embodiments the filtering efficiency is greater than 65%. In some embodiments the filtering efficiency is greater than 70%. In some embodiments the filtering efficiency is greater than 75%. In some embodiments the filtering efficiency is greater than 80%.

In some embodiments, the filtering fabric provides both mechanical and electrostatic filtration. In some embodiments, the filtering fabric includes at least one layer of material that can be electrostatically charged. In some embodiments, the filtering fabric includes at least one layer of material that is electrostatically charged.

In some embodiments, the filtering fabric comprises a cotton fabric. The cotton fabric preferably has a high weave density measured in threads per inch. The cotton fabric may have a visible raised fiber or nap such as found on flannels. In some embodiments, the thread count is greater than about 300 threads per inch. In some embodiments, the thread count is greater than about 400 threads per inch. In some embodiments, the thread count is greater than about 500 threads per inch. In some embodiments, the thread count is greater than about 600 threads per inch.

In some embodiments, the cotton fabric comprises a cotton quilt material, comprising two cotton sheets enclosing a batting. The batting has a thickness, which can be about one half a centimeter. Each cotton sheet in the cotton quilt has a thread count of greater than 100 threads per inch.

In some embodiments, the filtering fabric comprises two or more layers of fabric. In some embodiments, the filtering fabric comprises a first layer of a first type of fabric, and a second layer of a second type of fabric. In some embodiments, the first type of fabric is different from the second type of fabric. In some embodiments, the first layer comprises a cotton layer and the second layer comprises one of a silk layer, a chiffon layer, or another cotton layer such as a flannel layer. In some embodiments, the first layer comprises a silk layer, and the second layer comprises a silk layer. In some embodiments, three or four or more silk layers can be used. In some embodiments, the first layer comprises a chiffon layer and the second layer comprises a chiffon layer.

In some embodiments, the filtering fabric comprises an electrospun nanofiber membrane, such as a polyester mesh. In some embodiments, the filtering fabric comprises a filtering material that can be used in an N95 mask. In some embodiments, the filtering fabric comprises a filtering material that can be used in a surgical mask. In some embodiments, the filtering fabric comprises a filtering material that can be used as a HEPA filter material. In some embodiments, the filtering fabric comprises a P100 particulate filter material.

Various embodiments of the filtering fabric can combine one or more of the foregoing materials or characteristics.

As noted above, by having sufficiently large air volumes in the air chambers, and sufficiently large surface areas for the fabric filters, a fan with lower rotational velocity, and lower pressures can be used. However, a high throughput air flow velocity is preferred as well. Thus, the fan can be a fan with low rotational velocity such as commonly used in computer equipment for cooling. Such a fan typically has a size of approximately 80 mm square or less, with a height of about 10 mm. Such a fan typically operates on five (5) to twelve (12) volts DC. A five-volt fan allows for a USB plug and battery to be used. The fan may be brushless, and may have one or more speeds, typically greater than 500 revolutions per minute (rpm) and less than 4000 rpm. Such a fan typically provides 10 to 50 cubic feet per minute (cfm) in airflow. A fan with lower acoustical noise is preferable. A tradeoff among rotational speed, air flow, and noise depends on fan design, including blade cage diameter and blade shape, but generally a larger fan diameter with a lower fan rotation velocity provides sufficient airflow with reduced noise.

The transparent face mask can be made of a variety of materials. The face mask can be rigid in a shape designed to mate with the exterior edge or surface face of the frame. The face mask can be flexible, allowing it to be laid flat when not in use. "Transparent" means allowing the wearer to see out of the face mask. A face mask can be used which allows visibility in only one direction. The face mask is preferably clear.

The fabric bottom preferably has a large surface area to keep a low pressure drop across the filter fabric from the first air chamber to the air outside the protective headgear. By having a low pressure drop, air is not pushed through the filtering fabric at high velocity. In some embodiments, the fabric bottom forms a seal around the neck and on the shoulders of the person. This seal can be formed by the weight and folding of the fabric bottom around the neck and on the shoulders. In some embodiments, the fabric bottom forms a cowl neck around the neck.

In some embodiments, the fabric bottom can form a kind of a cloth tube hanging from the frame and the transparent face mask. For example, such a cloth tube can be much longer than a distance from the frame to shoulders of the person. Such a "tube" may be understood in terms of a cross-section (which can be any shape, and need not be circular or elliptical), and how this cross-section changes in area over the length of the tube (which can be constant, increasing in area, or non-uniformly changing). At a top end of the cloth tube, a top edge is shaped to match an edge defined by the face mask and the headband frame when the face mask is attached to the frame. At an opposite end, any edge shape can be used. Any of a variety of aesthetic and functional features can be provided on the fabric bottom, such as pockets, drawstrings, or other features. The cloth tube can include sections with filter fabric and other sections without filter fabric.

Also, the fabric bottom defines the first air chamber so that it has sufficient air volume so that when the person takes a breath, air pressure in the first air chamber does not change significantly. For example, the first air chamber has a volume of at least five liters. Thus, breathed air is exhausted through the fabric bottom and replenished with filtered air by the fan.

When the fan is operating while the protective headgear is worn, airflow through the fabric top, second air chamber, and fan into the first air chamber is matched with ventilation, moisture control, and positive pressure seal of the first air chamber. But, when the fan is off while the protective headgear is being worn, a surface area of the filtering fabric of the fabric top and the fabric bottom is such that enough air diffuses into the first air chamber to allow the person to breathe.

The fabric bottom preferably includes sufficient fabric to allow the person to touch, with a hand, an object in the first air chamber without breaking the seal around the neck, such that the filtering fabric remains between the hand and the object being touched. For example, the fabric bottom preferably includes sufficient fabric to allow the person to scratch the face, ears, head, neck, or touch anything worn such as headphones, without breaking the seal around the neck. The wearer can keep hands outside of the air chamber and use excess fabric to wipe moisture off the transparent face mask without passing anything through the neck seal.

The fabric bottom preferably is flexible enough and the first air chamber has enough volume, so that the person can slip a hand completely inside the first air chamber without opening a significant area of the neck seal, and with minimal impact to air pressure in the first air chamber. For example, the fabric bottom preferably is flexible enough and includes sufficient fabric to allow the person to put a hand inside the first air chamber, without breaking the seal around the neck. For example, the wearer may wish to consume food or drink, wipe their face with another cloth, or to clean the transparent face mask. In such embodiments, positive pressure protection is maintained while the wearer's hand, other object, or food or drink is passed into the first air chamber.

With such a construction of a protective headgear, the frame, fan, and fabric filters can be lightweight. Each of the components can be lightweight, removable, and replaceable, allowing the protective headgear to be readily portable and manufactured at lower cost. The protective headgear also can be modular. For example, the fabric top and fabric bottom can be manufactured and sold separately, allowing different sets of fabric tops and fabrics bottoms to be used with the same frame, and allowing them to be removed and washed as needed. As another example, given specifications for a fan, an individual can purchase and use any fan meeting desired specifications, and can repair and replace any malfunctioning fan. As another example, the transparent face mask can be replaceable, and different face masks can be used for different purposes.

One or more kits can be provided. For example, a kit can include a frame, a face mask, a fabric top, and a fabric bottom. As another example, a kit can include a frame and a face mask. As another example, a kit can include the fabric top and fabric bottom designed to meet specifications of a particular frame and face mask. The frame in the kit may or may not incorporate the fan and any associated electronics or control. Any kit can optionally include a material seal as well. A kit can be "flat-packed" into a carrying case.

Accordingly, in one aspect, a protective headgear to be worn on a head of a person, comprises a frame comprising a fan compartment and a headband. The headband has a front portion and a back portion and is constructed and arranged to be worn on the head of the person. The fan compartment is formed along the front portion of the headband. A fan is supported within the fan compartment. The fan compartment may be defined by a back interior edge along the front portion of the headband and a front interior edge along a front section of the frame. The fan can be located between the front and back interior edges. A transparent face mask is connected along an exterior edge or surface of the fan compartment. A fabric bottom formed of a filtering fabric is connected along an edge of the transparent face mask and along a bottom portion of the frame, so as to form a first air chamber defined by the frame, the transparent face mask, and the fabric bottom, wherein the fabric bottom forms a lower filter surface. A fabric top formed of a filtering fabric is connected on a top portion of the frame so as to form a second air chamber defined by the frame and the fabric top, wherein the fabric top forms an upper filter surface.

In another aspect, a kit for a protective headgear to be worn on a head of a person, comprising a frame and a transparent face mask. The frame comprises a fan compartment and a headband. The headband has a front portion and a back portion and is constructed and arranged to be worn on the head of the person. The fan compartment is formed along a front portion of the headband and is sized to house a fan. The kit may include the fan. The transparent face mask is constructed and arranged to be connected along the frame when the protective headgear is worn.

In another aspect, a kit for a protective headgear to be worn on a head of a person, comprises a frame comprising a fan compartment and a headband. The headband has a front portion and a back portion and is constructed and arranged to be worn on the head of the person. The fan compartment is formed along the front portion of the headband. The fan compartment may be defined by a back interior edge along the front portion of the headband and a front interior edge along a front section of the frame. The fan compartment is sized to house a fan. The kit may include the fan. The fan, when installed, is located between the front and back interior edges. The kit further may include a transparent face mask constructed and arranged to be connected along an exterior edge or surface of the fan compartment. The kit further may include a fabric bottom formed of a filtering fabric constructed and arranged to be connected along an edge of the transparent face mask and along a bottom portion of the frame, so as to form a first air chamber defined by the frame, the transparent face mask, and the fabric bottom, wherein the fabric bottom forms a lower filter surface. The kit further may include a fabric top formed of a filtering fabric constructed and arranged to be connected on a top portion of the frame so as to form a second air chamber defined by the frame and the fabric top, wherein the fabric top forms an upper filter surface.

In another aspect, a kit for a protective headgear to be worn on a head of a person, comprises a transparent face mask, a fabric bottom, and a fabric top. The transparent face mask is constructed and arranged to be connected along an exterior edge or surface of a frame of the protective headgear when the protective headgear is worn. The fabric bottom formed of a filtering fabric and is constructed and arranged to be connected along an edge of the transparent face mask and along a bottom portion of the frame when the protective headgear is worn, so as to form a first air chamber defined by the frame, the transparent face mask, and the fabric bottom, wherein the fabric bottom forms a lower filter surface. The fabric top formed of a filtering fabric and constructed and arranged to be connected along a top portion of the frame when the protective headgear is worn, so as to form a second air chamber defined by the frame and the fabric top, wherein the fabric top forms an upper filter surface.

In another aspect, a kit of fabrics for a protective headgear to be worn on a head of a person, the protective headgear including a frame and transparent face mask, comprises a fabric bottom and a fabric top. The fabric bottom is formed of a filtering fabric and is constructed and arranged to be connected along an edge of the transparent face mask and along a bottom portion of the frame when the protective headgear is worn, so as to form a first air chamber defined by the frame, the transparent face mask, and the fabric bottom, wherein the fabric bottom forms a lower filter surface. The fabric top is formed of a filtering fabric and is constructed and arranged to be connected along a top portion of the frame when the protective headgear is worn, so as to form a second air chamber defined by the frame and the fabric top, wherein the fabric top forms an upper filter surface.

In another aspect, a protective headgear comprises a frame including a fan compartment and a headband. The headband is constructed and arranged to be worn on the head of the person. The fan compartment is connected to the headband and has an air inlet formed in a top portion of the frame and an air outlet formed in a bottom portion of the frame. A fan is arranged in the fan compartment such that in operation the fan draws air into the fan compartment through the air inlet and pushes air out the air outlet. A transparent face mask is connected to the frame. A fabric bottom formed of a first filtering fabric is connected along an edge of the transparent face mask and along the bottom portion of the frame, so as to form a first air chamber receiving air from the air outlet and defined by the frame, the transparent face mask, and the fabric bottom, wherein the fabric bottom forms a lower filter surface. A fabric top formed of a second filtering fabric is connected on a top portion of the frame so as to form a second air chamber providing air to the air inlet and defined by the frame and the fabric top, wherein the fabric top forms an upper filter surface.

In another aspect, a protective headgear comprises a frame including a fan compartment and means for supporting the fan compartment on a head of a person. The fan compartment has an air inlet formed in a top portion of the frame and an air outlet formed in a bottom portion of the frame. A fan is arranged in the fan compartment such that in operation the fan draws air into the fan compartment through the air inlet and pushes air out the air outlet. A transparent face mask is connected to the frame. The protective headgear further includes means for forming a first air chamber with the transparent mask and bottom of the frame to receive air from the air outlet, the first air chamber further including a lower filter surface. The protective headgear further including means for forming a second air chamber with the top portion of the frame to provide air to the air inlet, the second air chamber including an upper filter surface.

In another aspect, a frame for a protective headgear comprises a fan compartment, a fan, and a headband. The fan compartment has an air inlet on a top of the frame, and an air outlet on a bottom of the frame. The headband is constructed and arranged to be worn on the head of the person. The fan is housed in the fan compartment and is constructed and arranged to draw air into the fan compartment through the air inlet and push air out through the air outlet. In some embodiments, the frame includes a transparent face mask. In some embodiments, the frame includes structures to connect a fabric top to the frame. In some embodiments, the frame includes structures to connect a fabric bottom to the frame.

In some embodiments of any of the foregoing, when the protective headgear is worn, the headband engages the head and forms a boundary to air flow around the head between the first air chamber and the second air chamber, such that air flow between the first air chamber and the second air chamber is primarily through the fan.

In some embodiments of any of the foregoing, when the fan is in operation while the headgear is being worn, the second air chamber is at lower pressure than air outside the protective headgear, and the first air chamber is at higher pressure than air outside the protective headgear, whereby the protective headgear provides filtered air through the upper filter surface from the second air chamber into the first air chamber to provide breathing volume for the person with positive pressure protection.

In some embodiments of any of the foregoing, the protective headgear can further include a hood constructed and arranged to cover the fabric top and at least the headband of the frame.

In some embodiments of any of the foregoing, one or more of the following features of the filtering fabric of the fabric bottom, or the fabric top, or both can be present. The filtering fabric comprises two or more layers of fabric. The filtering fabric comprises a first layer of a first type of fabric, and a second layer of a second type of fabric. The first type of fabric is different from the second type of fabric. The first layer comprises a cotton layer and the second layer comprises one of a silk layer, a chiffon layer, or another cotton layer such as a flannel layer. The first layer comprises a silk layer, and the second layer comprises a silk layer. Three or four or more silk layers can be used. The first layer comprises a chiffon layer and the second layer comprises a chiffon layer.

In some embodiments of any of the foregoing, the fan comprises a fan with low rotational velocity. In some embodiments, when the fan is operating while the protective headgear is worn, airflow through the fabric top, second air chamber, and fan into the first air chamber is matched with ventilation, moisture control, and positive pressure seal of the first air chamber.

In some embodiments of any of the foregoing, the fabric bottom has a large surface area to keep a low pressure drop across the filter fabric from the first air chamber to the air outside the protective headgear. In some embodiments, the low pressure drop is such that air is not pushed through the filtering fabric at high velocity.

In some embodiments of any of the foregoing, the first air chamber has air volume such that when the person takes a breath, air pressure in the first air chamber does not change significantly so that breathed air is exhausted through the fabric bottom and replenished with filtered air by the fan. In some embodiments, the first air chamber has a volume of at least five liters.

In some embodiments of any of the foregoing, a surface area of the filtering fabric of the fabric top and the fabric bottom is such that, when the fan is off while the protective headgear is being worn, enough air diffuses into the first air chamber to allow the person to breathe.

In some embodiments of any of the foregoing, a seal around a neck of the person is formed by the fabric bottom. In some embodiments, the seal around the neck is formed by weight and folding of the fabric bottom. In some embodiments, the fabric bottom forms a cowl neck around the neck. In some embodiments, the fabric bottom comprises sufficient fabric to allow the person to scratch the face without breaking the seal around the neck. In some embodiments, the fabric bottom comprises sufficient fabric to allow the person to clean the transparent face mask without breaking the seal around the neck. In some embodiments, the fabric bottom comprises sufficient fabric to allow the person to touch, with a hand, an object in the first air chamber without breaking the seal around the neck, such that the filtering fabric remains between the hand and the object being touched. In some embodiments, the fabric bottom is flexible enough and the first air chamber has enough volume, so that the person can slip a hand completely inside the first air chamber without opening a significant area of the neck seal, and with minimal impact to air pressure in the first air chamber. In some embodiments, positive pressure protection is maintained while food or drink is passed into the first air chamber. In some embodiments, the fabric bottom houses a plurality of batteries along the seal around the neck. In some embodiments, the fabric bottom forms a cloth tube hanging from the frame and the transparent face mask. In some embodiments, the cloth tube is much longer than a distance from the frame to shoulders of the person.

It should be understood that the subject matter defined in the appended claims is not necessarily limited to the specific implementations described above. The specific implementations described above are disclosed as examples only.

What is claimed is:

1. A protective headgear to be worn on a head of a person, comprising:

a frame comprising a fan compartment and a headband, the headband having a front portion and a back portion and constructed and arranged to be worn on the head of the person;

a fan within the fan compartment;

a transparent face mask connected along an exterior edge or surface of the fan compartment;

a fabric bottom formed of a filtering fabric and connected along an edge of the transparent face mask and along a bottom portion of the frame, so as to form a first air chamber defined by the frame, the transparent face mask, and the fabric bottom, wherein the fabric bottom forms a lower filter surface;

a fabric top formed of a filtering fabric and connected on a top portion of the frame so as to form a second air chamber defined by the frame and the fabric top, wherein the fabric top forms an upper filter surface;

wherein when the protective headgear is worn, the headband engages the head and forms a boundary to air flow around the head between the first air chamber and the second air chamber, such that air flow between the first air chamber and the second air chamber is primarily through the fan; and wherein when the fan is in operation while the headgear is being worn, the second air chamber is at lower pressure than air outside the protective headgear, and the first air chamber is at higher pressure than air outside the protective headgear, whereby the protective headgear provides filtered air through the upper filter surface from the second air chamber into the first air chamber to provide breathing volume for the person with positive pressure protection.

2. The protective headgear of claim 1 wherein the filtering fabric of the fabric top comprises a first layer of fabric and a second layer of fabric.

3. The protective headgear of claim 2, wherein the filtering fabric of the fabric top comprises a first layer of cotton and a second layer of synthetic chiffon.

4. The protective headgear of claim 1, wherein the fabric bottom has a surface area configured to keep a low pressure drop across the filter fabric from the first air chamber to the air outside the protective headgear.

5. The protective headgear of claim 4, wherein the low pressure drop is such that air is not pushed through the filtering fabric at high velocity.

6. The protective headgear of claim 1, wherein the fan comprises a fan with low rotational velocity.

7. The protective headgear of claim 1, wherein the first air chamber has air volume such that when the person takes a breath, air pressure in the first air chamber does not change significantly so that breathed air is exhausted through the fabric bottom and replenished with filtered air by the fan.

8. The protective headgear of claim 1, wherein the first air chamber has a volume of at least five liters.

9. The protective headgear of claim 1, wherein the filtering fabric of the fabric top and the fabric bottom has a surface area configured to diffuse air into the first chamber when the fan is off and the protective headgear is worn to allow the person to breathe.

10. The protective headgear of claim 1, wherein the fabric bottom forms a cloth tube hanging from the frame and the transparent face mask.

11. The protective headgear of claim 10, wherein the cloth tube is configured to be longer than a distance from the frame to the person's shoulders.

12. The protective headgear of claim 1, wherein a seal is formed around a neck of the person by the fabric bottom when the protective headgear is worn.

13. The protective headgear of claim 12, wherein the seal is formed around the neck by a weight and folded configuration of the fabric bottom when the protective headgear is worn.

14. The protective headgear of claim 13, wherein the fabric bottom is configured to form a cowl neck around the neck of the person wearing the protective headgear.

15. The protective headgear of claim 12, wherein the fabric bottom is of a size to allow the person to scratch the face without breaking the seal around the person's neck.

16. The protective headgear of claim 12, wherein the fabric bottom is of as size to allow the person to clean the transparent face mask without breaking the seal around the person's neck.

17. The protective headgear of claim 12, wherein the fabric bottom is of a size to allow the person wearing the protective headgear to touch, with a hand, an object in the first air chamber without breaking the seal around the neck, such that the filtering fabric remains between the hand and the object being touched.

18. The protective headgear of claim 12, wherein the fabric bottom is flexible and the first air chamber has an internal volume such that the person can slip a hand completely inside the first air chamber while maintaining air pressure in the first air chamber that provides the positive pressure protection.

19. A protective headgear comprising;

a frame comprising a fan compartment and a headband, the headband constructed and arranged to be worn on the head of a person, the fan compartment connected to the headband and having an air inlet formed in a top portion of the frame and an air outlet formed in a bottom portion of the frame;

a fan arranged in the fan compartment and configured to draw air into the fan compartment through the air inlet and to push air out the air outlet;

a transparent face mask connected to the frame;

a fabric bottom formed of a first filtering fabric and connected along an edge of the transparent face mask and along the bottom portion of the frame, configured to form a first air chamber receiving air from the air outlet and defined by the frame, the transparent face mask, and the fabric bottom, wherein the fabric bottom forms a lower filter surface; and a fabric top formed of a second filtering fabric and connected on a top portion of the frame configured to form a second air chamber providing air to the air inlet and defined by the frame and the fabric top, wherein the fabric top forms an upper filter surface.

20. The protective headgear of claim 19, wherein the filtering fabric of the fabric top comprises a first layer of fabric and a second layer of fabric.

21. The protective headgear of claim 20, wherein the filtering fabric of the fabric top comprises a first layer of cotton and a second layer of synthetic chiffon.

22. The protective headgear of claim 19, wherein the fabric bottom has a surface area configured to keep a low pressure drop across the filter fabric from the first air chamber to the air outside the protective headgear.

23. The protective headgear of claim 22, wherein the low pressure drop is such that air is not pushed through the filtering fabric at high velocity.

24. The protective headgear of claim 19, wherein the fan comprises a fan with low rotational velocity.

25. The protective headgear of claim 19, wherein the first air chamber has air volume such that when the person takes a breath, air pressure in the first air chamber does not change significantly so that breathed air is exhausted through the fabric bottom and replenished with filtered air by the fan.

26. The protective headgear of claim 19, wherein the first air chamber has a volume of at least five liters.

27. The protective headgear of claim 19, wherein the filtering fabric of the fabric top and the fabric bottom has a surface area configured to diffuse air into the first chamber when the fan is off and the protective headgear is worn to allow the person to breathe.

28. The protective headgear of claim 19, wherein the fabric bottom forms a cloth tube hanging from the frame and the transparent face mask.

29. The protective headgear of claim 28, wherein the cloth tube is configured to be longer than a distance from the frame to the person's shoulders.

30. The protective headgear of claim 19, wherein a seal is formed around a neck of the person by the fabric bottom when the protective headgear is worn.

* * * * *